US006736560B2

(12) United States Patent
Nemoto

(10) Patent No.: US 6,736,560 B2
(45) Date of Patent: May 18, 2004

(54) PRINTER

(75) Inventor: Yusuke Nemoto, Iwanuma (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/531,497

(22) Filed: Mar. 21, 2000

(65) Prior Publication Data

US 2003/0161674 A1 Aug. 28, 2003

(30) Foreign Application Priority Data

Jun. 9, 1999 (JP) ..... 11-161833
Nov. 15, 1999 (JP) ..... 11-324306

(51) Int. Cl.[7] ..... B41J 13/02

(52) U.S. Cl. ..... 400/634; 400/636; 400/701; 347/104

(58) Field of Search ..... 400/634, 701, 400/702, 702.1, 679, 636, 637; 347/103; 101/114–115, 120, 127

(56) References Cited

U.S. PATENT DOCUMENTS 5,163,674 A * 11/1992 Parks ..... 271/274
5,636,929 A * 6/1997 Asano et al. ..... 400/641
5,719,611 A * 2/1998 Nakamura et al. ..... 347/103
5,988,061 A * 11/1999 Kagawa ..... 101/128.4

FOREIGN PATENT DOCUMENTS

JP 1-202487 8/1989
JP 7-81202 3/1995
JP 8-91710 4/1996
JP 9-188057 7/1997
JP 10-157083 6/1998
JP 10-166705 * 6/1998
JP 11-91074 4/1999
JP 11-277719 10/1999

* cited by examiner

*Primary Examiner*—Minh H Chau
(74) *Attorney, Agent, or Firm*—Oblon, Spivak, McClelland, Maier & Neustadt, P.C.

(57) ABSTRACT

A removing member which rotates while being in contact with the periphery of a rotating member for conveying a sheet of paper that rotates while being in contact with a printed side of a sheet of paper is provided. When undried ink on the printed side is transferred to the periphery of the rotating member at the time of conveying the printed sheet, the undried ink is thinly spread in a part where the periphery of the rotating member and the periphery of the removing member come into contact with each other and therefore dried quicker. The removing member removes a part of the ink from the periphery of the rotating member. Consequently, the printed sheet is prevented from being smudged by the re-transfer. Since double-side printing or multicolor printing can be started before the ink on the printed side of the printed sheet of paper is completely dried, the work efficiency of the double-side printing or multicolor printing is improved.

5 Claims, 12 Drawing Sheets

PRINTER

BACKGROUND OF THE INVENTION

1. Field of the Invention

The present invention relates to a printer for carrying a sheet of paper at least one side of which is printed and performing printing again on the sheet such as double-side printing for printing the other side of the printed side or multicolor printing for printing the printed side in ink of a different color.

2. Description of the Prior Art

Conventionally, double-side printing and multicolor printing by a printer having a single cylindrical print drum is widely performed. According to the double-side printing, a sheet of paper of which one side has been printed is set on a paper supply tray or the like and conveyed, and the other side is printed in the paper conveying process. According to the multicolor printing, a sheet of paper of which one side has been printed in ink of a certain color is set on a paper supply tray or the like and conveyed, and the printed side is printed in ink of another color during the paper conveying process.

In the case of performing the double-side printing or the multicolor printing, what is called a re-transferred smudge (roller track smudge) occurs on the printed sheet as follows. When a rotating member (such as pick-up roller, separation roller, resist roller, or press roller) for conveying the printed sheet comes into contact with undried ink on the printed side of the printed sheet, the undried ink is transferred to the periphery of the rotating member and the undried ink transferred to the rotating member is transferred again to the printed side of the printed sheet.

In order to prevent the occurrence of the retransfer smudge, the double-side printing or multicolor printing is performed after sufficiently drying the ink on the printed side of the printed sheet.

When the double-side printing or multicolor printing is performed after the ink on the printed side of the printed sheet is sufficiently dried, the waiting time is long and it causes a problem such that the efficiency of the double-side printing and the multicolor printing deteriorates.

SUMMARY OF THE INVENTION

It is an object of the present invention to prevent a smudge occurring when a printed sheet of paper at least whose one side has been printed is conveyed and printed again for double-side printing or multicolor printing.

Another object of the present invention is to improve work efficiency of a case where a printed sheet of paper at least whose one side has been printed is conveyed and printed again for double-side printing or multicolor printing.

According to a printer of the present invention, each of rotating members for feeding a sheet of paper which are disposed along a guide path including a printing unit with a removing member which rotates while being in contact with the periphery of the rotating member so as to spread ink passed on the rotating member, so that the removing member removes a part of the ink from the rotating member.

According to another aspect of the present invention, the periphery of one of the rotating members is made of a material to which ink is not easily adhered. The rotating members are disposed via a guide path and rotate, so that the rotating members contribute to convey a sheet of paper. The guide path includes a printing unit.

According to another aspect of the present invention, a pair of first and second resist rollers disposed upstream of the printing unit via a guide path are provided. The periphery of the first resist roller is made of a material to which ink is not easily adhered and the periphery of the second resist roller is made of a material having elasticity to assure a paper conveying force. Another pair of first and second resist rollers disposed upstream of the printing unit via the guide path are also provided. The periphery of the first resist roller is made of a material to which ink is not easily adhered and the periphery of the second resist roller is made of a material having elasticity to assure a paper conveying force. The disposing positions of the first and second resist rollers with respect to the guide path as a center are opposite to those of the foregoing pair of resist rollers. The first and second resist rollers in either one of the pairs of resist rollers are allowed to be in contact with each other. The first and second resist rollers in the other pair of resist rollers are allowed to be apart from each other.

According to further aspect of the present invention, a pair of first and second resist rollers disposed upstream of the printing unit in the guide path of a sheet of paper are provided via the guide path. The periphery of the first resist roller is made of a material to which ink is not easily adhered and the periphery of the second resist roller is made of a material having elasticity to assure a paper conveying force. The positions of the first and second resist rollers with respect to the guide path as a center are reversed as appropriate.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

A first embodiment of the invention will be described with reference to FIGS. 1 and 2.

Figure 1:
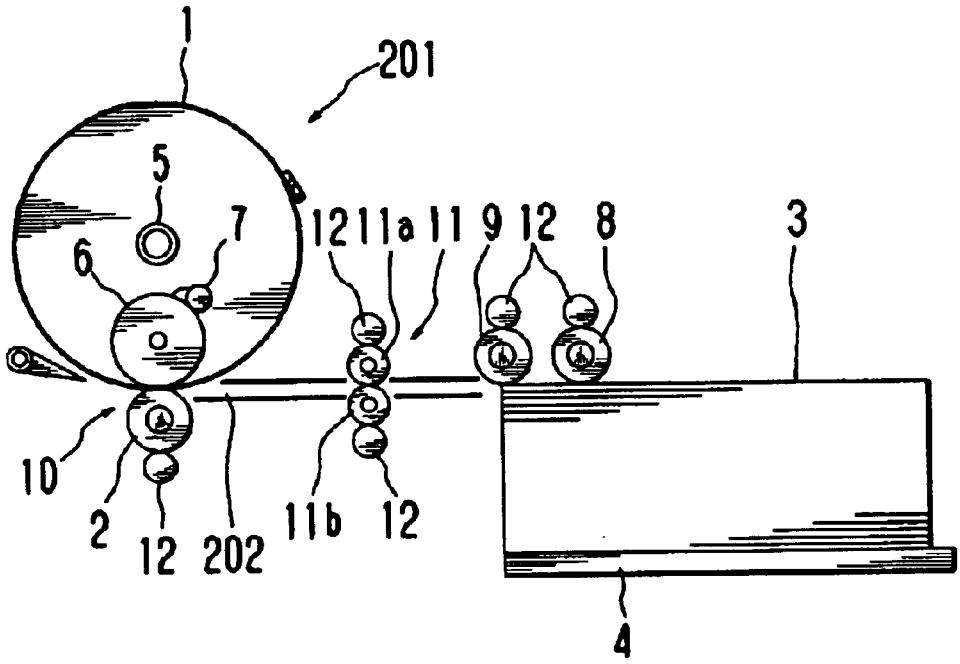
FIG. 1 is a front view showing a part of a stencil printer according to a first embodiment of the invention.

FIG. 1 is a front view showing a part of a stencil printer as an example of the printer. The stencil printer has a printing unit 201 having a porous cylindrical print drum 1 rotating around an axial line, a press roller 2 as a rotating member provided so as to be movable to be in contact with and be away from the periphery of the print drum 1, and a master making unit (not shown) for making a master (not shown) wound around a periphery of the print drum 1. The stencil printer comprises a paper supply tray 4 on which a sheet of paper fed to a guide path 202 including the printing unit 201, that is, a printed sheet 3 at least whose one side is printed or a sheet of paper which is not printed (not shown) is set. In the print drum 1, an ink pipe 5 which is positioned on the axial line of the print drum 1 and also serves as a spindle for rotatably supporting the print drum 1, an ink roller 6 rotated in the same direction as the print drum 1 with a very small gap with the inner periphery of the print drum 1, a doctor roller 7 arranged with a very small gap with the periphery of the ink roller 6, and the like are arranged.

A pick-up roller 8 as a rotating member and a separation roller 9 as a rotating member are disposed above the paper supply tray 4. The pick-up roller 8 and the separation roller 9 feed the printed sheets 3 or unprinted sheets set on the paper supply tray 4 one by one. Further, a pair 11 of resist rollers are provided between a printing section 10 in which the print drum 1 and the press roller 2 are in contact and press against each other and the paper supply tray 4. The pair 11 of resist rollers 11*a* and 11*b* are provided as rotating members. The pair 11 of resist rollers feed the printed sheet 3 or unprinted sheet conveyed to the pair 11 of resist rollers to the printing section 10 at a proper timing.

A removing roller 12 as a removing member is rotatably disposed next to each of the press roller 2, pick-up roller 8, separation roller 9, and resistor rollers 11*a* and 11*b*. The periphery of the removing roller 12 is in contact with the periphery of each of the press roller 2, pick-up roller 8, separation roller 9, and resist rollers 11*a* and 11*b* by a pressing member such as a spring. The removing roller 12 is rotated by the frictional resistance of the contact part. An elastic material such as chloroprene rubber, silicon rubber, nitrile rubber, or EP (ethylene propylene) rubber is used as the material of the removing roller 12.

Figure 2:
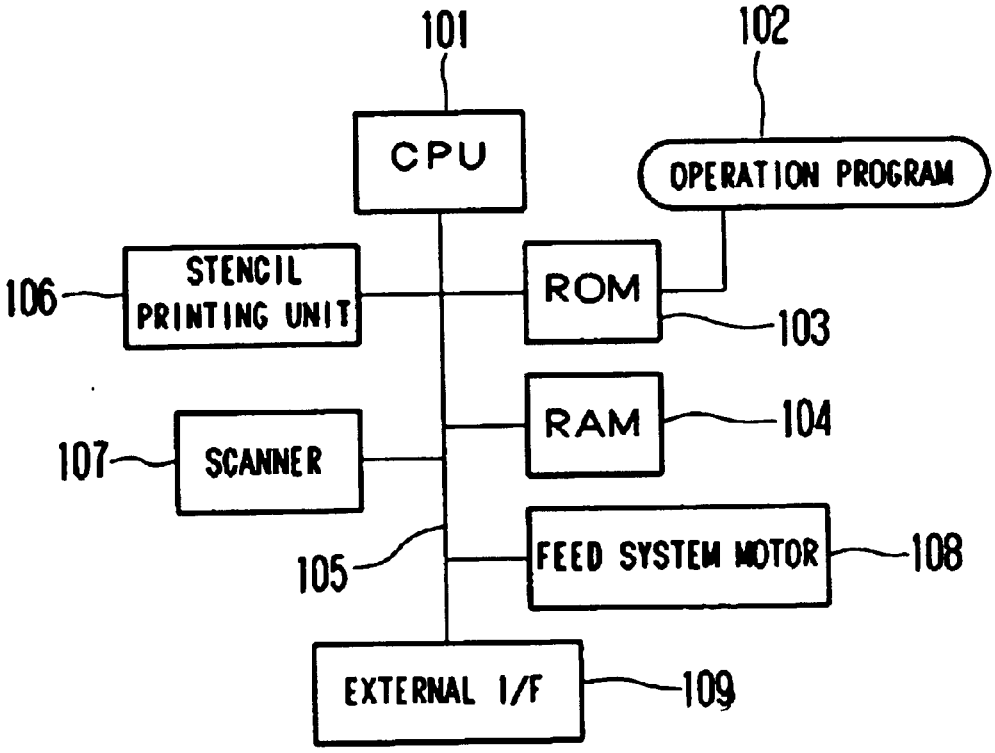
FIG. 2 is a block diagram showing electric connection provided in the stencil printer.

FIG. 2 is a block diagram showing electric connection of units. A CPU 101 for executing various computing processes and controlling the components is provided. To the CPU 101, a ROM 103 for fixedly storing fixed data such as an operation program 102 and a RAM 104 for rewritably storing variable data and functioning as a working area are connected via a system bus 105, thereby constructing a microcomputer for controlling the components connected to the system bus 105, that is, a stencil printing unit 106, a scanner 107, and a feed system motor 108. Specifically, the stencil printer of the embodiment drives the components such as the stencil printing unit 106, scanner 107, and feed system motor 108 in accordance with the operating program 102 stored in the ROM 103 to execute a stencil printing operation according to image data read by the scanner 107. Although the example of forming an image in accordance with the image data read by the scanner 107 is described here, image data may be transmitted from an external I/F connected to the system bus 105.

In the stencil printing operation, various kinds of the feed system motors 108 are driven in accordance with the operating program 102, thereby driving the press roller 2, pick-up roller 8, separation roller 9, resist rollers 11*a* and 11*b* and the like. A sheet of paper is consequently fed from the paper supply tray 4 to the guide path 202 and the fed sheet is conveyed while being guided along the guide path 202. An operation of the printing, especially, the printed sheet 3 will be described hereinafter.

In the case of performing the double-side printing, the printed sheet 3 is set on the paper supply tray 4 with the printed side facing downward and printing is performed on the other side which has not been printed. In the case of performing the multicolor printing, the printed sheet 3 is set on the paper supply tray 4 with the side printed in ink of a certain color facing upward. The printed sheet 3 is fed toward the printing section 10 and the printed side is printed in ink of a different color.

At the time of conveying the printed sheet 3 in the case of performing the double-side printing, the printed side of the printed sheet 3 faces downward. Consequently, the lower resist roller 11*b* and the press roller 2 come into contact with the printed side of the printed sheet 3. When the ink on the printed side is not dried yet, the undried ink is transferred to the periphery of the resist roller 11*b* and that of the press roller 2. The undried ink transferred onto the peripheries of the resist roller 11*b* and the press roller 2 is spread thinly in the contact part between the periphery of the resist roller 11*b* and the periphery of the removing roller 12 and the contact part between the periphery of the press roller 2 and the periphery of the removing roller 12, and a part of the undried ink is transferred to the periphery of the removing roller 12. That is, the removing roller 12 removes the part of the undried ink from the peripheries of the resist roller 11*b* and the press roller 2.

Consequently, since the undried ink transferred onto the periphery of the resist roller 11*b* and that of the press roller 2 is transferred to the peripheries of the removing rollers 12, the amount of ink on the peripheries of the resist roller 11*b* and the press roller 2 is reduced. The ink is thinly spread and the area of the ink in contact with air increases, so that the ink is dried quicker. Consequently, the transfer of the undried ink passed to the peripheries of the resist roller 11*b* and the press roller 2 again to the printed side of the printed sheet 3 is suppressed, so that the printed sheet 3 is prevented from being smudged by the re-transfer.

The printed side of the printed sheet 3 faces upward when the printed sheet 3 is conveyed in the case of performing the multicolor printing. When the pick-up roller 8, separation roller 9 and upper resist roller 11*a* come into contact with the printed side of the printed sheet 3 and the ink on the printed side is not dried yet, the undried ink is transferred to the peripheries of the pick-up roller 8, separation roller 9, and resist roller 11*a*. The undried ink transferred to the peripheries of the pick-up roller 8, separation roller 9, and resist roller 11*a* is thinly spread in the contact part between each of the peripheries of the pick-up roller 8, separation roller 9, and resist roller 11*a* and each of the peripheries of the removing rollers 12 and a part of the undried ink is transferred to the periphery of each removing roller 12. That is, the removing roller 12 removes the part of the undried ink from the pick-up roller 8, separation roller 9, and resist roller 11*a*.

Consequently, since the undried ink passed onto the peripheries of the pick-up roller 8, separation roller 9, and resist roller 11*a* is transferred to the peripheries of the removing rollers 12, the amount of ink on the peripheries of the pick-up roller 8, separation roller 9, and resist roller 11*a* is reduced. The ink is thinly spread and the area of the ink in contact with air increases, so that the ink is dried quicker. Consequently, the transfer of the undried ink passed onto the peripheries of the pick-up roller 8, separation roller 9, and resist roller 11*a* again to the printed side of the printed sheet 3 is suppressed, so that the printed sheet 3 is prevented from being smudged by the re-transfer.

By providing such removing rollers 12, in a period from the end of the printing on one side to the start of the double-side printing or multicolor printing, it is unnecessary to wait long until the ink on the printed side is sufficiently dried. Thus, the work efficiency of the double-side printing and multicolor printing is improved.

Although the dried ink is adhered to the peripheries of the removing rollers 12 and the peripheries of the pick-up roller 8, separation roller 9, resist rollers 11*a* and 11*b*, and press roller 2, the dried ink is returned to the printed sheet 3 little by little during the printed sheet 3 is conveyed. Consequently, a large amount of dried ink is not adhered to the peripheries of the removing rollers 12, pick-up roller 8, separation roller 9, resist rollers 11*a* and 11*b*, and press roller 2. Since the dried ink is returned to the printed sheet 3 little by little, the printed sheet 3 is not smudged by the returned ink.

Figure 3:
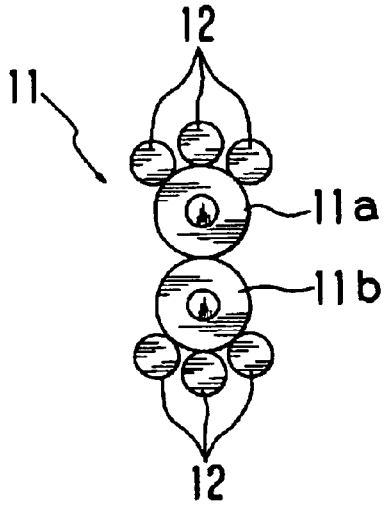
FIG. 3 is a front view showing the section of a pair of resist rollers in a stencil printer according to a second embodiment of the invention.

A second embodiment of the invention will now be described with reference to FIG. 3. The same components as those of the first embodiment are designated by the same reference numerals and their description is omitted here. In a stencil printer of the embodiment, a plurality of removing rollers 12 are in contact with the periphery of each of the resist rollers 11*a* and 11*b*.

With such a configuration, since the number of parts in contact with the removing rollers 12 in each of the resist rollers 11*a* and 11*b* increases, the ink transferred to the resist rollers 11*a* and 11*b* is spread more thinly and is dried quicker. Moreover, the amount of undried ink which is transferred to the peripheries of the resist rollers 11*a* and 11*b* and then to the removing rollers 12 increases. The printed sheet 3 is therefore prevented more from being smudged by the retransfer.

Although the case where the number of the removing rollers 12 in contact with the resist rollers 11*a* and 11*b* is increased has been described as an example in the embodiment, similarly, the number of the removing rollers 12 in contact with the pick-up roller 8, separation roller 9, press roller 2, and the like may be also increased.

A third embodiment of the invention will be described by referring to FIGS. 4 and 5. The same components as those of the first embodiment are designated by the same reference numerals and their description is omitted here.

Figure 4:
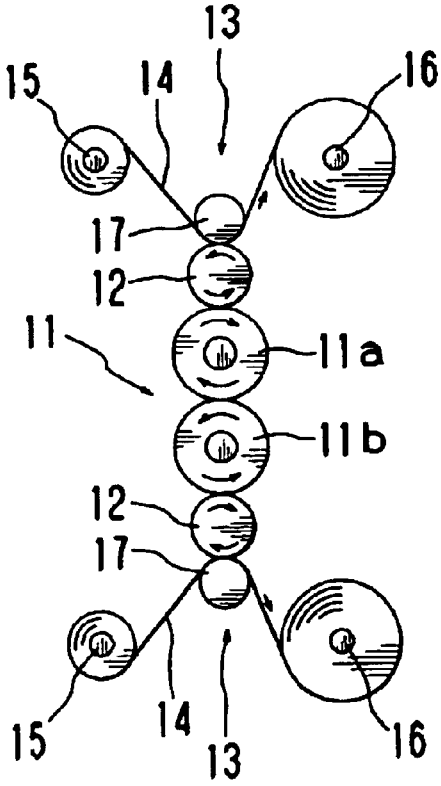
FIG. 4 is a front view showing the section of a pair of resist rollers in a stencil printer according to a third embodiment of the invention.

FIG. 4 is a front view mainly showing the pair 11 of resist rollers in a stencil printer. In the stencil printer of the embodiment, a cleaning unit 13 for cleaning the periphery of each removing roller 12 is provided. The cleaning unit 13 comprises an ink wiping sheet 14 made of nonwoven fabric or the like for wiping ink transferred on the periphery of the removing roller 12 by being pressed against the periphery of the removing roller 12, a feed shaft 15, a winding shaft 16, and a press roller 17.

Figure 5:
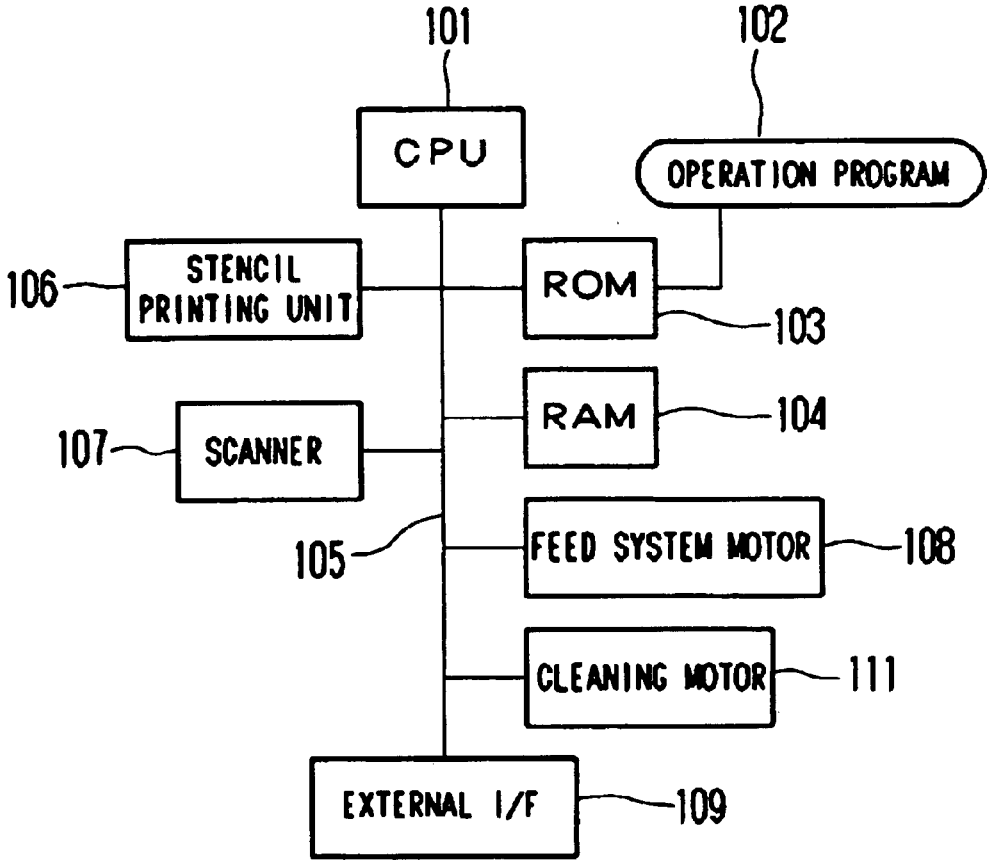
FIG. 5 is a block diagram showing electric connection provided in the stencil printer.

FIG. 5 is a block diagram showing electric connection of components. In the embodiment, a cleaning motor 111 that drives the winding shaft 16 of the cleaning unit 13 is connected to the CPU 101 via the system bus 105. The action based on the driving control of the feed system motor 108 and the cleaning motor 111 in accordance with the operation program 102 will now be described.

Driving the cleaning motor 111 rotates the winding shaft 16 and the ink wiping sheet 14 is taken up in the direction opposite to the rotating direction of the removing roller 12. The ink transferred onto the periphery of the removing roller 12 is wiped by the ink wiping sheet 14, the transfer of the undried ink passed to the peripheries of the resist rollers 11*a* and 11*b* to the removing rollers 12 is promoted, and the ink amount on the resist rollers 11*a* and 11*b* is reduced. Consequently, the amount of re-transfer of the ink passed on the peripheries of the resist rollers 11*a* and 11*b* to the printed side of the printed sheet 3 is further reduced and the printed sheet 3 is prevented more from being smudged by the re-transfer.

Although the case of providing the cleaning unit 13 for cleaning the peripheries of the removing rollers 12 which are in contact with the resist rollers 11*a* and 11*b* has been described in the embodiment, such a cleaning unit 13 may be also provided in a position to clean another removing roller 12.

Figure 6:
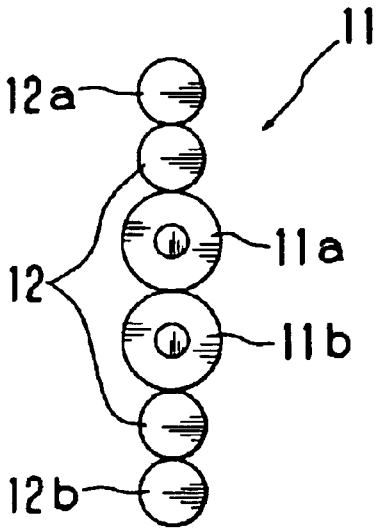
FIG. 6 is a front view showing the section of a pair of resist rollers in a stencil printer according to a fourth embodiment of the invention.

A fourth embodiment of the invention will now be described by referring to FIG. 6. The components same as those of the first embodiment are designated by the same reference numerals and their description is omitted here.

In the stencil printer of the embodiment, the removing roller 12 is in contact with the periphery of each of the resist rollers 11*a* and 11*b* and an auxiliary removing roller 12*a* as an auxiliary removing member is in contact with the periphery of each of the removing rollers 12.

With such a configuration, a part of the undried ink transferred from the printed side of the printed sheet 3 to the peripheries of the resist rollers 11*a* and 11*b* is transferred from the resist rollers 11*a* and 11*b* to the peripheries of the removing rollers 12 and then transferred from the peripheries of removing rollers 12 to the peripheries of the auxiliary removing rollers 12*a*. The amount of ink transferred from the resist rollers 11*a* and 11*b* to the removing rollers 12 increases, the amount of ink on the resist rollers 11*a* and 11*b* is reduced, and the printed sheet 3 is prevented more from being smudged by the re-transfer.

Although the case that the auxiliary removing rollers 12*a* are in contact with the peripheries of the removing rollers 12 which are in contact with the resist rollers 11*a* and 11*b* has been described in the embodiment, similar auxiliary removing rollers 12*a* may be in contact with the peripheries of the removing rollers 12 which are in contact with the pick-up roller 8, separation roller 9, press roller 2, and the like.

The periphery of the auxiliary removing roller 12*a* of the embodiment may be also cleaned by the cleaning unit 13 as shown in FIG. 4. The transfer of the ink from the periphery of the removing roller 12 to the periphery of the auxiliary removing roller 12*a* is consequently promoted, the amount of ink on the removing roller 12 is reduced, and the transfer of ink from the resist rollers 11*a* and 11*b* to the removing rollers 12 is promoted, so that the printed sheet 3 is prevented more from being smudged by the re-transfer.

Figure 7:
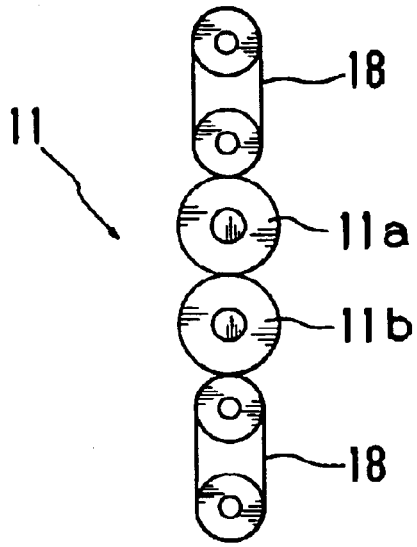
FIG. 7 is a front view showing the section of a pair of resist rollers in a stencil printer according to a fifth embodiment of the invention.

A fifth embodiment of the invention will be described by referring to FIG. 7. The components same as those of the first embodiment are designated by the same reference numerals and their description is omitted here.

In a stencil printer of the embodiment, as a removing member in contact with the periphery of each of the resist rollers 11*a* and 11*b*, a removing belt 18 as a removing member is provided in place of the removing roller 12. As the removing belt 18, a sheet which has porosity to divide ink (emulsion ink) into a pigment and the other components and remove the components from a printed side of a printed matter and has a holding layer for holding the components separated from the pigment as disclosed in Japanese Unexamined Patent Publication No. Hei 11-91074 or a member having the critical surface tension of 30 dyne/cm or higher disclosed in Japanese Unexamined Patent Publication No. Hei 11-277719 can be used. The techniques disclosed in the publications are incorporated in this specification.

With such a construction, the removing belt 18 functions in a manner similar to the removing roller 12. The undried ink transferred to the resist rollers 11*a* and 11*b* is thinly spread and a part of it is transferred to the periphery of the removing belt 18. That is, the removing belt 18 removes the undried ink from the periphery of the resist rollers 11*a* and 11*b*. Thus, the printed sheet 3 is prevented from being smudged by the re-transfer.

Although the removing belts 18 in contact with the resist rollers 11*a* and 11*b* have been described as an example in the embodiment, similar removing belts 18 may be in contact with the pick-up roller 8, separation roller 9, press roller 2, and the like.

The periphery of the removing belt 18 in the embodiment may be also cleaned by the cleaning unit 13 as shown in FIG. 4. It promotes the transfer of ink from the periphery of each of the resist rollers 11*a* and 11*b* to the periphery of the removing belt 18, the amount of ink on the resist rollers 11*a* and 11*b* is accordingly reduced, and the printed sheet 3 is prevented more from being smudged by the re-transfer.

In each of the foregoing embodiments, the resist rollers 11*a* and 11*b* may be rotated not only at the time of conveying the printed sheet 3 by the resist rollers 11*a* and 11*b* but also at the time of, for example, making a master.

When the tip of the printed sheet 3 reaches the printing section 10 (sandwiched between the print drum 1 and the press roller 2 as shown in FIG. 1), usually, the pressure between the resist rollers 11*a* and 11*b* is cancelled and the resist rollers 11*a* and 11*b* stop rotating. At the time of making a master, the pressure between the resist rollers 11*a* and 11*b* is cancelled and the rotation of the resist rollers 11*a* and 11*b* is stopped. By rotating the resist rollers 11*a* and 11*b* in a state where the pressure between the resist rollers 11*a* and 11*b* is cancelled, the ink transferred onto the peripheries of the resist rollers 11*a* and 11*b* and the periphery of the removing roller 12 is spread more thinly, the ink is dried further quicker, and the printed sheet 3 is further prevented from being smudged by the re-transfer.

A sixth embodiment of the invention will now be described with reference to FIGS. 8 and 9. The components same as those of the first embodiment are designated by the same reference numerals and their description is omitted here.

Figure 8:
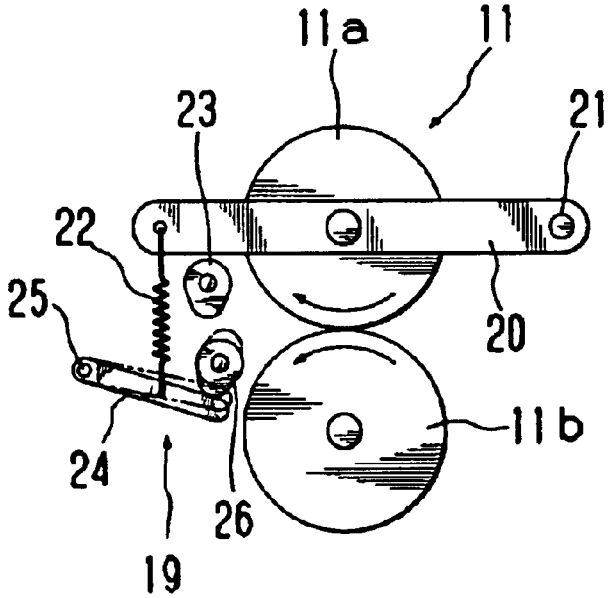
FIG. 8 is a front view showing a feed pressure adjusting mechanism in a stencil printer according to a sixth embodiment of the invention.

As shown in FIG. 8, a stencil printer of the embodiment is provided with a feed pressure adjusting mechanism 19 for varying the feed pressure between the resist rollers 11*a* and 11*b* during the printed sheet 3 is carried by the resist rollers 11*a* and 11*b*.

The resist roller 11*b* is fixedly attached to a fixed frame (not shown) and the resist roller 11*a* is attached almost in the center part of an arm 20. The arm 20 is turnably supported around a spindle 21 provided at one end of the arm 20 as a fulcrum. One end of a spring 22 for urging the resist roller 11*a* so as to be pressed against the resist roller 11*b* is retained by the other end of the arm 20. A cam 23 is disposed at the other end side of the arm 20. When the cam 23 rotates to a predetermined position, the arm 20 is pushed up in the direction opposite to the pulling direction by the spring 22 and the resist rollers 11*a* and 11*b* are apart from each other.

The other end of the spring 22 is retained by an almost central part of the arm 24. The arm 24 is supported turnably around the spindle 25 provided at its one end as a fulcrum. A cam 26 is brought into contact with the other end of the arm 24. By the rotation of the cam 26, the feed pressure between the resist rollers 11*a* and 11*b* is varied. The feed pressure adjusting mechanism 19 is constructed by the spring 22, arm 24, and cam 26.

Figure 9:
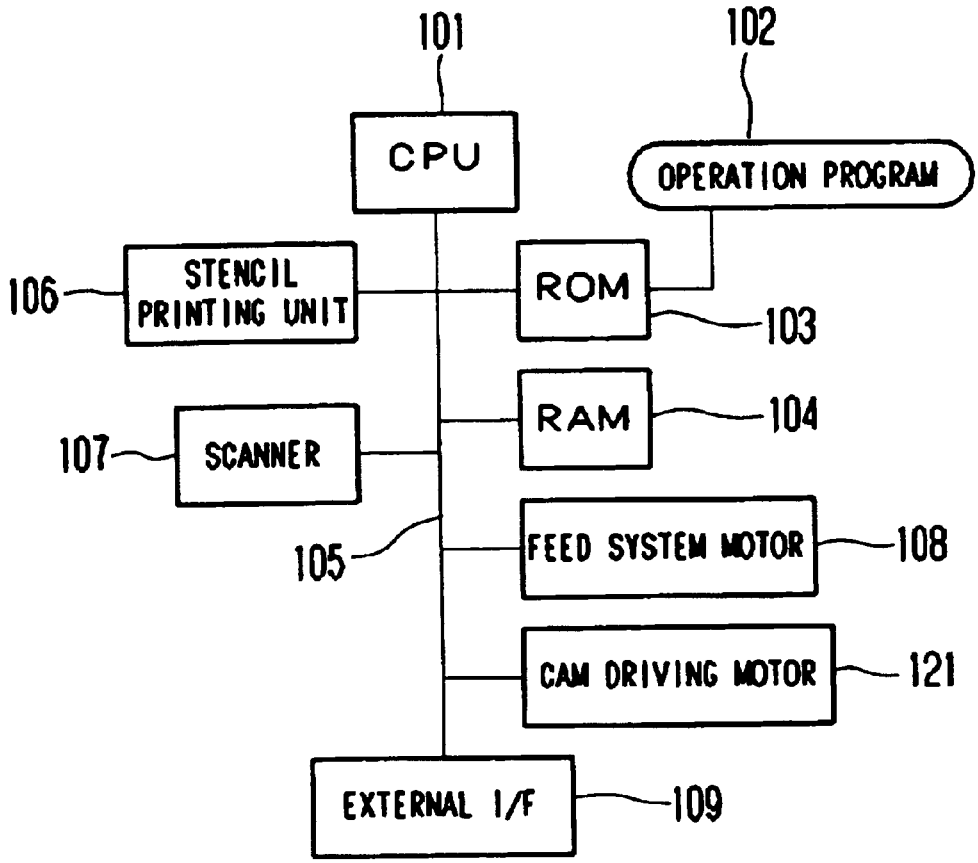
FIG. 9 is a block diagram showing electric connection provided in the stencil printer.

As shown in the block diagram of FIG. 9, the cam 26 is driven by a cam driving motor 121. The cam driving motor 121 is controlled by the CPU 101 in accordance with the operation program 102. Specifically, the cam driving motor 121 is controlled so that the feed pressure adjusting mechanism 19 increases the feed pressure of the pair 11 of the resist rollers at the start of paper feed by the pair 11 of resist rollers and decreases the feed pressure of the pair 11 of resist rollers after the carriage of the sheet by the pair 11 of resist rollers is started.

With such a configuration, in a state where the cam 23 applies pressure as illustrated in FIG. 8 and the tip of the printed sheet 3 is in contact with the nip part of the resist rollers 11*a* and 11*b*, the resist rollers 11*a* and 11*b* start rotating, so that the operation of which starting up to feed the printed sheet 3 by the resist rollers 11*a* and 11*b*. Since slip or unfeeding of the printed sheet 3 tends to occur at the start of carriage, the cam 26 is moved to the position shown by a solid line and the arm 24 is turned to the position shown by a solid line, thereby increasing the feed pressure between the resist rollers 11*a* and 11*b* and preventing the occurrence of slip or unfeeding.

After the printed sheet 3 enters between the resist rollers 11*a* and 11*b* and is started to be conveyed by the resist rollers 11*a* and 11*b*, the cam 26 is moved to the position shown by a two alternate long and two short dashes line and the arm 24 is turned to the position shown by a two alternate long and short dashes line to thereby reduce the feed pressure between the resist rollers 11*a* and 11*b*. By the operation, the contact pressure of the resist rollers 11*a* and 11*b* to the printed side of the printed sheet 3 is decreased and the transfer amount of the undried ink from the printed side to the peripheries of the resist rollers 11*a* and 11*b* is reduced, so that the printed sheet 3 is prevented from being smudged by the re-transfer.

A seventh embodiment of the invention will now be described by referring to FIGS. 10 and 11. The components same as those of the sixth embodiment are designated by the same reference numerals and their description is omitted here.

Figure 10:
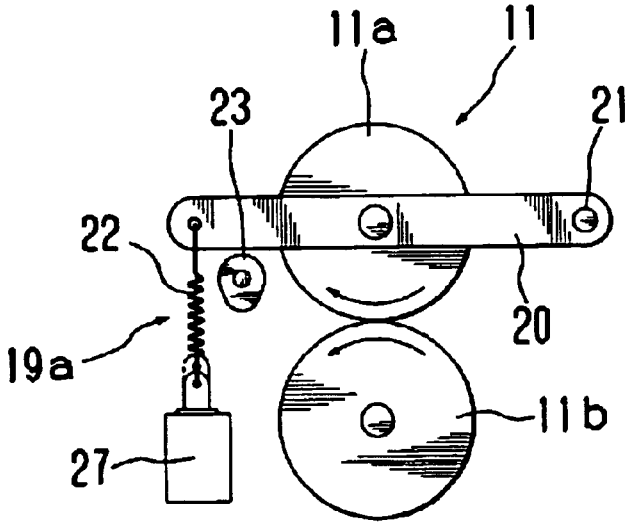
FIG. 10 is a front view showing a feed pressure adjusting mechanism in a stencil printer according to a seventh embodiment of the invention.
Figure 11:
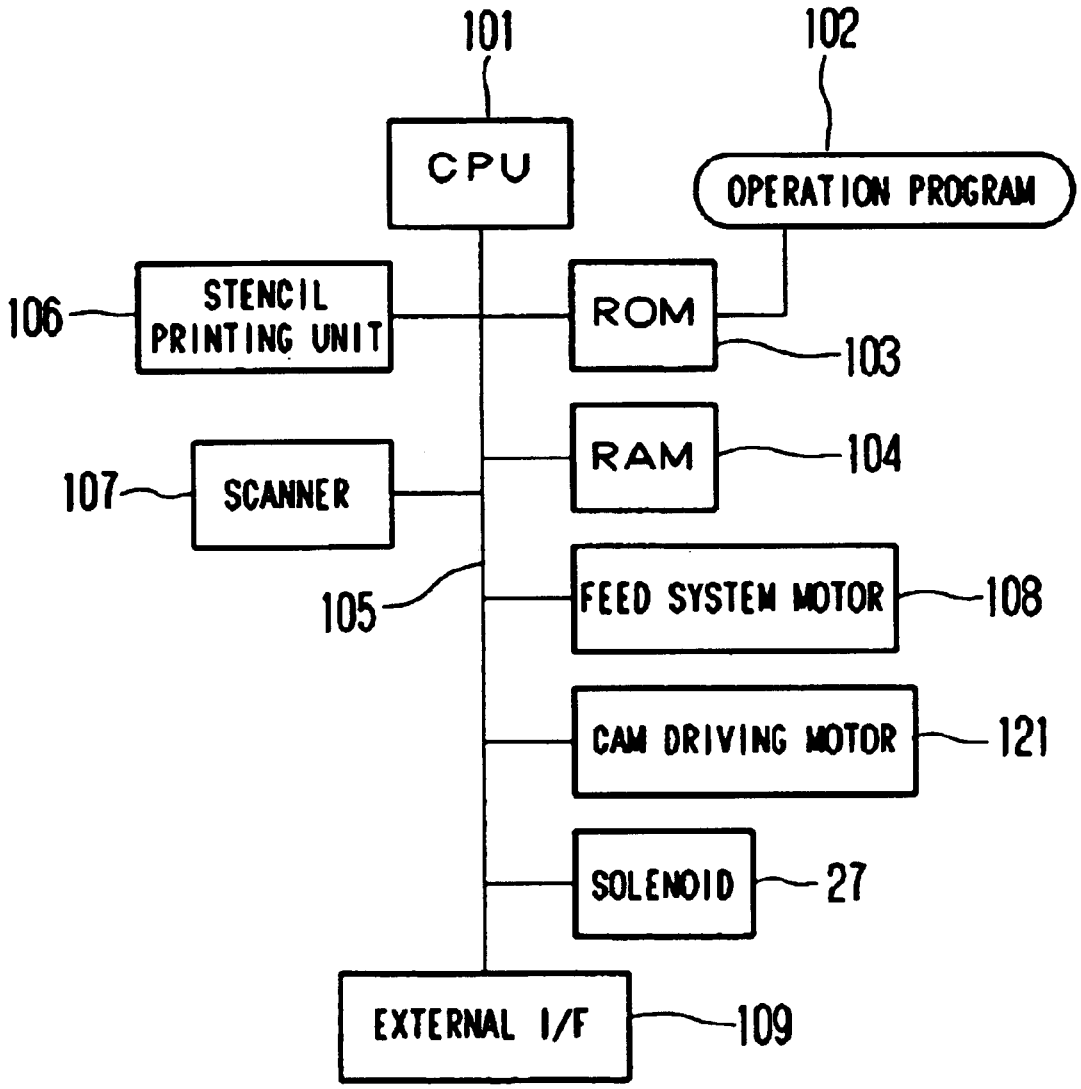
FIG. 11 is a block diagram showing electric connection provided in the stencil printer.

As shown in FIG. 10, a stencil printer of the embodiment is provided with a feed pressure adjusting mechanism 19*a* for varying the feed pressure between the resist rollers 11*a* and 11*b* during the feed of the printed sheet 3 by the resist rollers 11*a* and 11*b*.

The feed pressure adjusting mechanism 19*a* is comprised of a spring 22 whose one end is retained by the arm 20 and a solenoid 27 by which the other end of the spring 22 is retained. As shown in FIG. 11, the solenoid 27 is connected to the CPU 101 via the system bus 105 and driven by the operation program 102 stored in the ROM 103.

With such a construction, when the carriage of the printed sheet 3 by the resist rollers 11*a* and 11*b* is started, the solenoid 27 is turned on to keep the tensile force of the spring 22, thereby increasing the feed pressure between the resist rollers 11*a* and 11*b*. Thus, occurrence of slip or unfeeding of the printed sheet 3 is prevented.

After the feed of the printed sheet 3 by the resist rollers 11*a* and 11*b* is started, the solenoid 27 is turned off to decrease the tensile force of the spring 22, thereby reducing the feed pressure between the resist rollers 11*a* and 11*b*. Consequently, the contact pressure of the resist rollers 11*a* and 11*b* to the printed side of the printed sheet 3 is decreased, the amount of the undried ink transferred from the printed side to the peripheries of the resist rollers 11*a* and 11*b* is reduced, and the printed sheet 3 is prevented from being smudged by the re-transfer.

An eighth embodiment of the invention will be described with reference to FIGS. 12 to 14. The same components as those of the first embodiment are designated by the same reference numerals and their description is omitted here.

Figure 12:
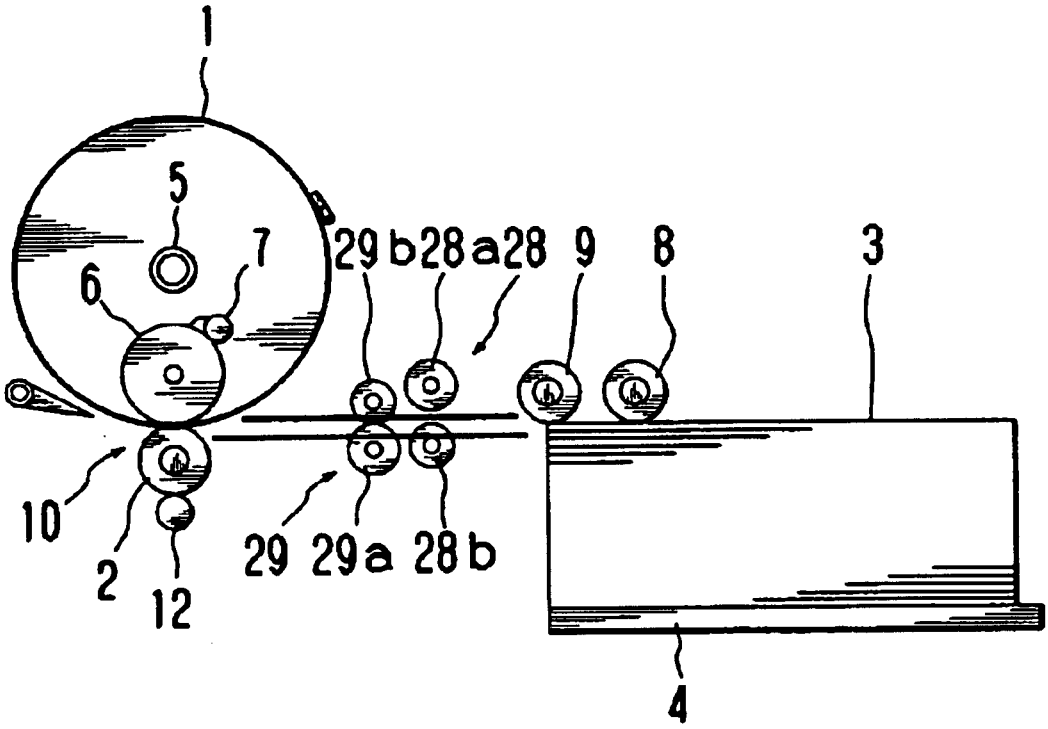
FIG. 12 is a front view showing a part of a stencil printer according to an eighth embodiment of the invention.
Figure 13:
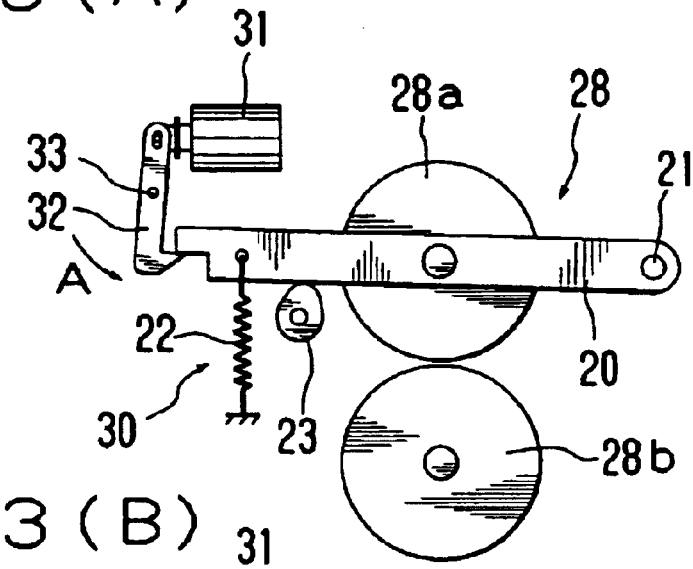
FIG. 13 is a front view for explaining a switching operation by a switching mechanism.
Figure 13:
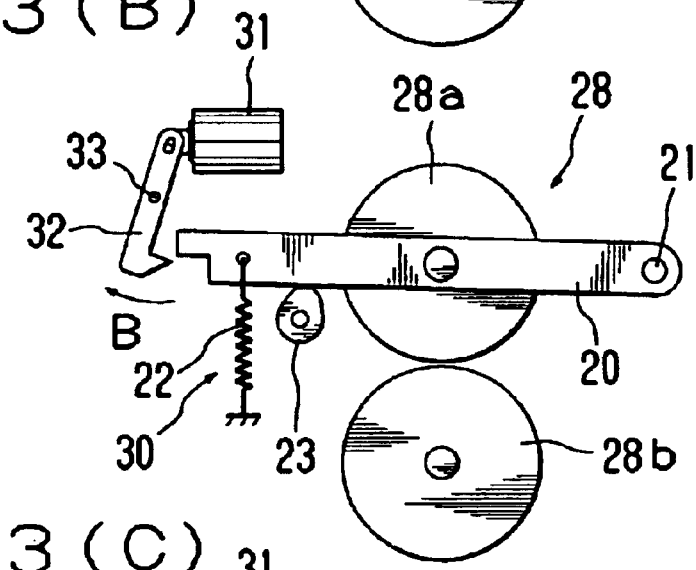
Figure 13:
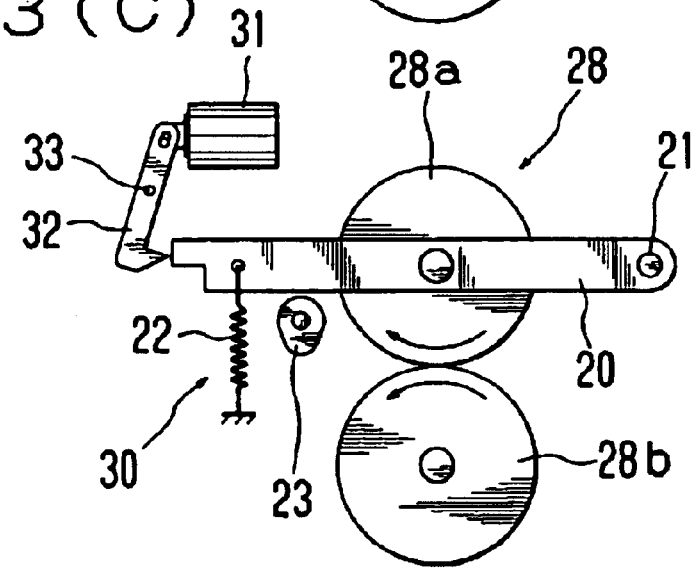

As shown in FIG. 12, in a stencil printer of the embodiment, two pairs 28 and 29 of resist rollers are provided close to each other. The pairs 28 and 29 of resist rollers comprise first resist rollers 28*a* and 29*a* whose peripheries are made of a material to which ink is not easily adhered and second resist rollers 28*b* and 29*b* whose peripheries are made of a material having elasticity to assure a paper feeding force, respectively. In the pair 28 of resist rollers, the first resist roller 28*a* is in the upper position. In the pair 29 of resist rollers, the first resist roller 29*a* is in the lower position.

Each of the pairs 28 and 29 of resist rollers is provided with a switching mechanism 30 for switching each of the first resist rollers 28*a* and 29*a* and each the second resist rollers 28*b* and 29*b* between a contact position where the peripheries comes into contact with each other and an apart position where the peripheries are apart from each other. At the time of conveying a printed sheet, one of the pairs 28 and 29 of resist rollers is used by the switching operation of the switching mechanisms 30.

The switching mechanism 30 is provided for each of the pairs 28 and 29 of resist rollers. Since the structures of the switching mechanisms 30 are the same, only the switching mechanism 30 provided for the pair 28 of resist rollers will be described. As shown in FIG. 13, the switching mechanism 30 comprises the arm 20, the cam 23, the spring 22, a solenoid 31, and a pawl 32 connected to the solenoid 31.

The arm 20 is provided turnably by using the spindle 21 provided at its one end as a fulcrum. The first resist roller 28*a* is rotatably supported in an almost central part of the arm 20. One end of the spring 22 is retained by the other end of the arm 20 and the other end of the spring 22 is retained by a fixed part. The spring 22 pulls the arm 20 so that the first resist roller 28*a* is pressed against the second resist roller 28*b* fixedly provided. The cam 23 is disposed at the other end side of the arm 20. When the cam 23 is turned to a predetermined position, the arm 20 is pushed up in the direction opposite to the pulling direction of the spring 22, so that the first and second resist rollers 28*a* and 28*b* move so as to be apart from each other. The pawl 32 is turnable around a spindle 33 as a fulcrum and is driven by the solenoid 31 to turn so as to be retained or released by/from the other end of the arm 20.

The periphery of each of the first resist rollers 28*a* and 29*a* is made of a material to which ink is not easily adhered such as tetrafluoroethylene resin, nylon, or polyacetal. On the other hand, the periphery of each of the second resist rollers 28*b* and 29*b* is made of an elastic material such as nitrile rubber or chloroprene rubber so as to assure the carrying force. The periphery of each of the pick-up roller 8, separation roller 9, and the press roller 2 is also made of a material to which ink is not easily adhered like the peripheries of the first resist rollers 28*a* and 29*a*.

Figure 14:
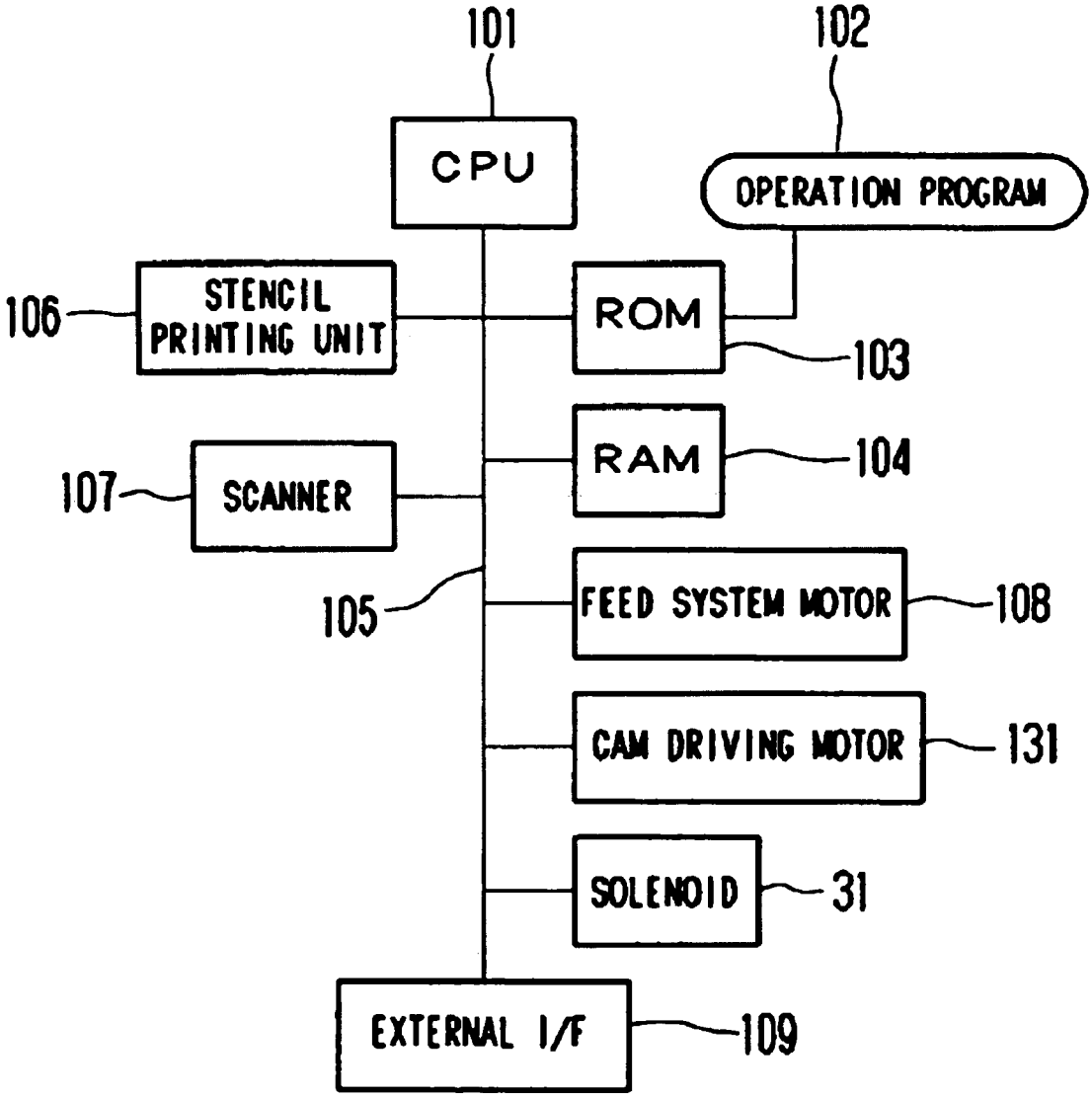
FIG. 14 is a block diagram showing electric connection provided in the stencil printer.

As shown in FIG. 14, a cam driving motor 131 as a driving source for driving the cam 23 is provided. The cam driving motor 131 and the solenoid 31 are connected to the CPU 101 via the system bus 105 and are driven by the operation program 102 stored in the ROM 103.

With such a configuration, when the first and second resist rollers 28*a* and 28*b* are moved apart from each other by the switching of the switching mechanism 30, the arm 20 is pushed up by rotating the cam 23 to the position shown in FIG. 13A so as to make the first and second resist rollers 28*a* and 28*b* apart from each other. After that, the passage of a current to the solenoid 31 is interrupted, thereby turning the pawl 32 in the direction of the arrow A so as to be retained by the arm 20. In such a state, even if the cam 23 rotates in any position after that, the arm 20 is not lowered and the first and second resist rollers 28*a* and 28*b* are maintained in a separated state.

In the case of allowing the first and second resist rollers 28*a* and 28*b* to come into contact with each other, a current is passed to the solenoid 31 and the pawl 32 is turned in the direction of the arrow B as shown in FIG. 13B so as to be released from the arm 20. After that, by turning the cam 23 to the position shown in FIG. 13C, the arm 20 is lowered by the tensile force of the spring 22 to make the first and second resist rollers 28*a* and 28*b* come into contact with each other.

In the case of the double-side printing, the switching mechanism 30 is switched so that the first and second resist rollers 28*a* and 28*b* are apart from each other and the first and second resist rollers 29*a* and 29*b* come into contact with each other as shown in FIG. 12. By using the pair 29 of resist rollers, the printed sheet 3 is fed. The side facing downward of the printed sheet 3 fed from the paper supply tray 4 for double-side printing is the printed side. The first resist roller 29*a* and the press roller 2 come into contact with the printed side in the carrying process.

Since the peripheries of the first resist roller 29*a* and the press roller 2 are made of the material to which the ink is not easily adhered, even when the first resist roller 29*a* and the press roller 2 come into contact with the printed side, the undried ink on the printed side is not easily transferred to the peripheries of the first resist roller 29*a* and the press roller 2, thereby preventing the printed sheet 3 from being smudged by the re-transfer.

At the time of multicolor printing for printing the printed side with ink of a different color, the switching mechanism 30 is switched so that the first and second resist rollers 29*a* and 29*b* are apart from each other and the first and second resist rollers 28*a* and 28*b* come into contact with each other and the printed sheet 3 is fed by using the pair 28 of resist rollers. The side facing upward of the printed sheet 3 fed from the paper supply tray 4 for multicolor printing is the printed side. The pick-up roller 8, separation roller 9, and first resist roller 28*a* come into contact with the printed side in the carrying process.

Since the periphery of each of the pick-up roller 8, separation roller 9, and first resist roller 28*a* is made of a material to which ink is not adhered, even if the pick-up roller 8, separation roller 9, and first resist roller 28*a* come into contact with the printed side, the undried ink on the printed side is not easily transferred to the periphery of each of the pick-up roller 8, separation roller 9, and first resist roller 28*a*. Thus, the printed sheet 3 is prevented from being smudged from the re-transfer.

Further, it is unnecessary to wait long until the ink on the printed side is sufficiently dried during the period of from the end of printing on one side until the double-side printing or multicolor printing is started. Thus, the work efficiency of the double-side printing and multicolor printing is improved.

A ninth embodiment of the invention will be described by referring to FIGS. 15 to 17. The same components as those of the first embodiment are designated by the same reference numerals and their description is omitted here.

Figure 15:
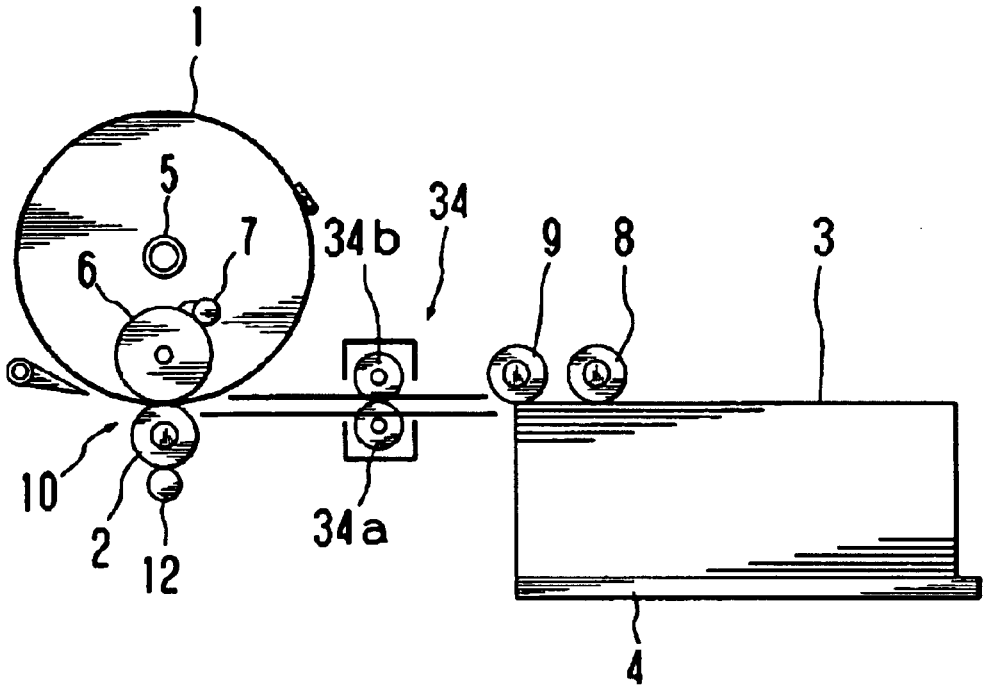
FIG. 15A is a front view showing a part of a stencil printer according to a ninth embodiment of the invention.
FIG. 15B is a front view showing a part of the stencil printer in a state where a pair of resist rollers are reversed from the state shown in FIG. 15A.
Figure 15:
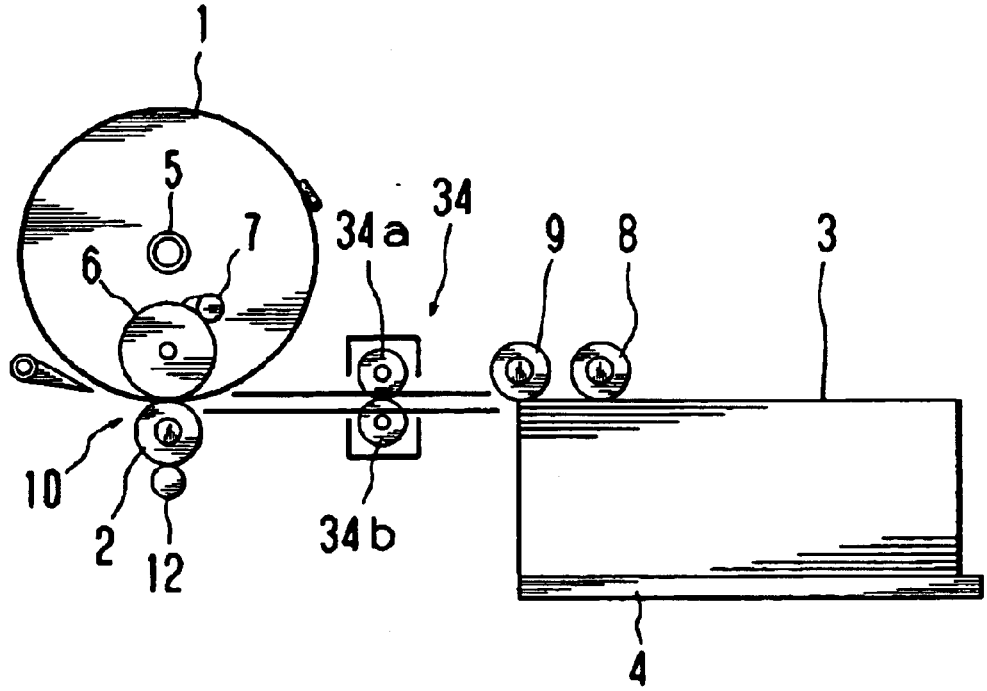

As shown in FIG. 15, a stencil printer of the embodiment uses a pair 34 of a first resistor roller 34*a* and a second resist roller 34*b*. The periphery of each of the pick-up roller 8, separation roller 9, first resist roller 34*a* and press roller 2 is made of a material to which ink is not adhered such as tetrafluoroethylene resin, nylon, or polyacetal. On the other hand, the periphery of the second resist roller 34*b* is made of an elastic material such as nitrile rubber or chloroprene rubber to assure the carrying force.

Figure 16:
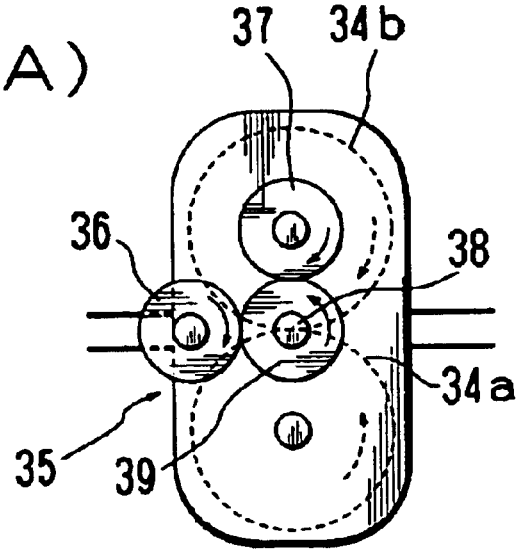
FIG. 16A is a front view of the pair of resist rollers for explaining a switching operation of a rotation switching mechanism for reversely rotating the pair of resist rollers.
FIG. 16B is a front view of the pair of resist rollers illustrating a state where the pair of resist rollers are turned and inclined by 45 degrees.
FIG. 16C is a front view of the pair of resist rollers showing the state where the resist rollers are reversed.
Figure 16:
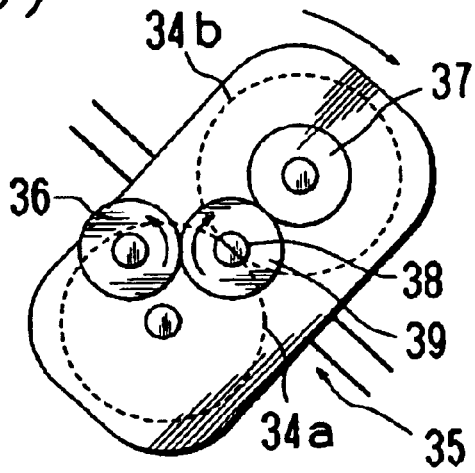
Figure 16:
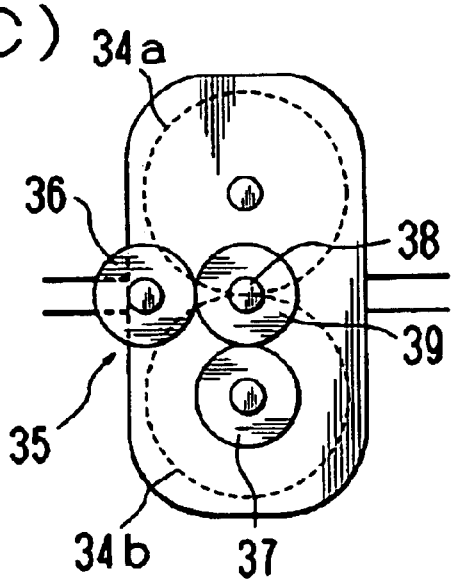

As shown in FIG. 16, a rotation switching mechanism 35 for changing the positions between the first and second resist rollers 34*a* and 34*b* by turning the whole pair 34 of resist rollers upside down is coupled to the pair 34 of resist rollers. The rotation switching mechanism 35 comprises a gear 36 to which a driving force from a reverse driving motor 141 (refer to FIG. 17) as a driving source of the whole printer is transmitted, a gear 37 fixed to the rotary shaft of the second resist roller 34*b*, a rotation center shaft 38 as a rotation center of the pair 34 of resist rollers, a gear 39 which is attached to the rotation center shaft 38 via an electromagnetic clutch 142 (refer to FIG. 17) and engaged with the gears 36 and 37, a sensor 143 (refer to FIG. 17) for sensing the rotation position of the pair 34 of resist rollers, and a lock pin (not shown) for locking the pair 34 of resist rollers in a predetermined turned position.

Figure 17:
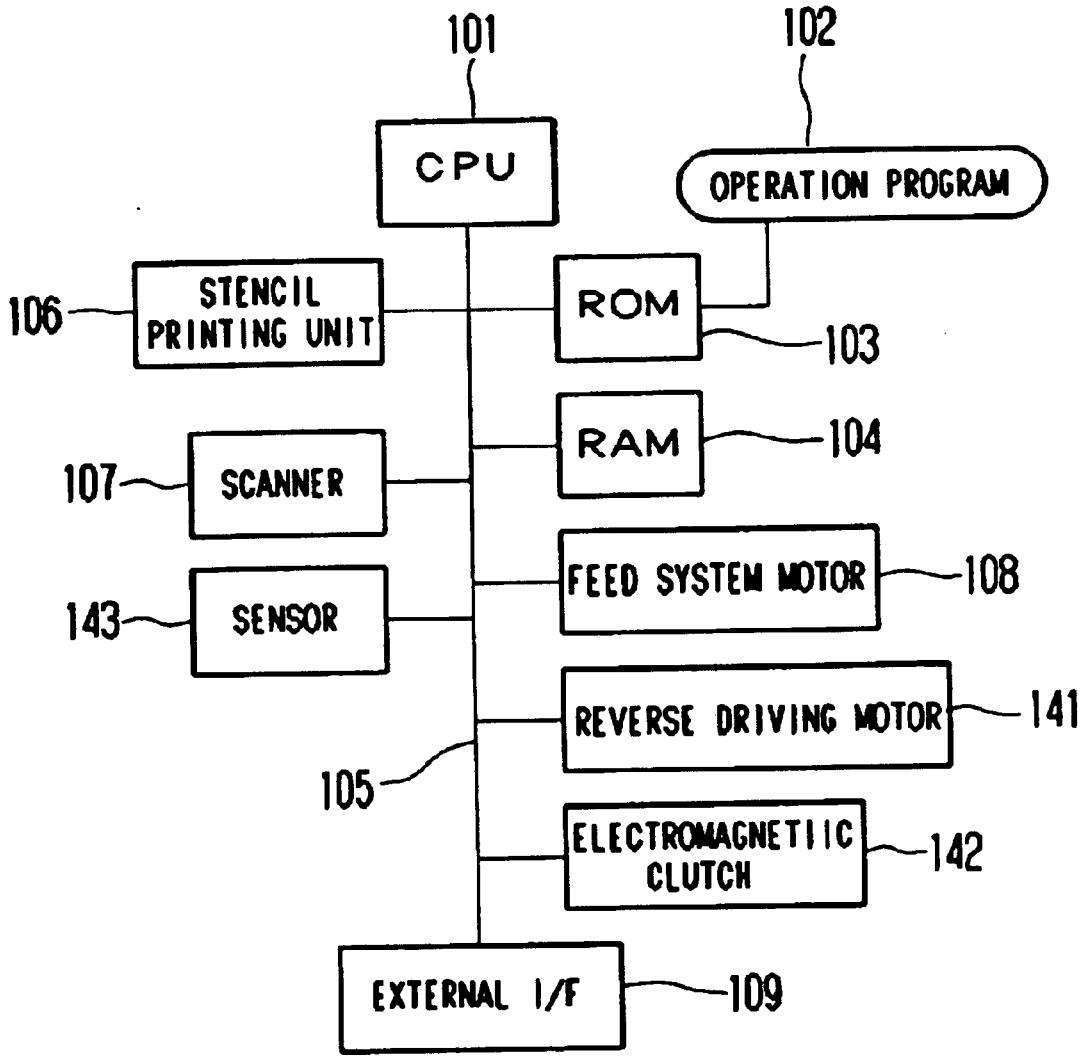
FIG. 17 is a block diagram showing electric connection provided in the stencil printer.

As illustrated in FIG. 17, the reverse driving motor 141 and the electromagnetic clutch 142 are connected to the CPU 101 via the system bus 105 and driven by the operation program 102 stored in the ROM 103. The sensor 143 is also connected to the CPU 101 via the system bus 105 and supplies information of detected rotation position of the pair 34 of resist rollers to the CPU 101.

With such a configuration, in the case of the double-side printing, as shown in FIGS. 15A and 16A, the whole pair 34 of resist rollers is turned by the rotation switching mechanism 35 so that the first resist roller 34*a* is in the lower position and the second resist roller 34*b* is in the upper position, and then the printing operation is started. At the time of printing operation, the electromagnetic clutch 142 is turned off and the gear 39 is rotatable around the rotation center shaft 38. When the printing operation is started, as shown in FIG. 16A, the gear 36 is rotated in the direction of the arrow by the driving force from the stencil printer body. The rotational force is transmitted via the gears 39 and 37 to the second resist roller 34*b* and the first resist roller 34*a* in contact with the second resist roller 34*b* is rotated. Consequently, the first and second resist rollers 34*a* and 34*b* rotate in the directions of the arrows and the printed sheet 3 is carried while being sandwiched by the first and second resist rollers 34*a* and 34*b*.

The side facing downward of the printed sheet 3 fed from the paper supply tray 4 for double-side printing is the printed side. The first resist roller 34*a* and the press roller 2 come into contact with the printed side in the paper conveying process. Since the periphery of each of the first resist roller 34*a* and the press roller 2 is made of a material to which ink is not easily adhered, even if the first resist roller 34*a* and the press roller 2 come into contact with the printed side, the undried ink on the printed side is not easily transferred to the peripheries of the first resist roller 34*a* and the press roller 2, so that the printed sheet 3 is prevented from being smudged by the retransfer.

At the time of multicolor printing for printing the printed side with ink of a different color, as shown in FIGS. 15B and 16C, the whole pair 34 of resist rollers is turned upside down by the rotation switching mechanism 35 so that the first resist roller 34*a* is in the upper position and the second resist roller 34*b* is in the lower position, and then the printing operation is started. In the case of turning the whole pair 34 of the resist rollers by the rotation switching mechanism 35, the electromagnetic clutch 142 is turned on and the gear 36 is turned in the direction of the arrow shown in FIG. 16B. The rotation center shaft 38 and the pair 34 of resist rollers are turned together with the gear 39 in the direction of the arrow and the first resist roller 34*a* is moved to the upper position as shown in FIG. 16C. After a sensor senses that the pair 34 of resist rollers has turned to the position in which the first resist roller 34*a* is on the upper side, the pair 34 of resist rollers is locked by a lock pin.

After the pair 34 of resist rollers is turned to a position where the first resist roller 34*a* is on the upper side, the electromagnetic clutch 142 is turned off and the gear 36 is rotated in the direction of the arrow shown in FIG. 16C. The rotational force is transmitted via the gears 39 and 37 to the second resist roller 34*b* and the first and second resist rollers 34*a* and 34*b* rotate in the directions of the arrows and the printed sheet 3 is carried while being held by the first and second resist rollers 34*a* and 34*b*.

The side facing upward of the printed sheet 3 fed from the paper supply tray 4 for multicolor printing is the printed side. The pick-up roller 8, separation roller 9 and the first resist roller 34*a* come into contact with the printed side in the carrying process. Since the periphery of each of the pick-up roller 8, separation roller 9, and first resist roller 34*a* is made of a material to which ink is not easily adhered, even if the pick-up roller 8, separation roller 9, and first resist roller 34*a* come into contact with the printed side, the undried ink on the printed side is not easily transferred to the peripheries of the pick-up roller 8, separation roller 9, and first resist roller 34*a*, so that the printed sheet 3 is prevented from being smudged by the re-transfer.

Further, it is unnecessary to wait long until ink on the printed side is sufficiently dried during the period from the end of printing on one side until the double-side printing or multicolor printing is started. Thus, the work efficiency of the double-side printing and multicolor printing is improved.

Although the rotation switching mechanism 35 comprising the gear 39 and the electromagnetic clutch 142 has been described as an example in the embodiment, a rotation switching mechanism which attaches/detaches the pair 34 of resist rollers to/from the stencil printer body without using the gear 39 and the electromagnetic clutch 142 may be also used. After detaching the pair 34 of resist rollers, it is attached upside down.

The present invention may be embodied in other specific forms without departing from the spirit or essential characteristics thereof. The present embodiments are therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Documents Hei 11-161833 filed on Jun. 9, 1999 and Hei 11-324306 filed on Nov. 11, 1999 the contents of which are incorporated herein by reference.

What is claimed is:

1. A stencil printer comprising:

a printing unit configured to print an image on a sheet of paper having undried ink previously printed on one side;

a guide path along which the sheet of paper is guided to the printing unit;

at least one rotating roller disposed adjacent to the guide path and configured to aid in guiding the sheet of paper along the guide path, the at least one rotating roller including a press roller and a position of the guide path being above the press roller during either double-sided or multi-color printing operations; and at least one removing roller in contact with an outer periphery of the at least one rotating roller and configured to rotate in order to both spread and reduce the undried ink from the previously printed side of the sheet transferred to the at least one rotating roller so that the ink on the outer periphery of the at least one rotating roller can be dried quickly.

2. The stencil printer according to claim 1, wherein the at least one removing roller rotates in accordance with the rotation of the at least one rotating roller in that the at least one removing roller rotates in a same rotative direction and at a same rotative velocity as the at least one rotating roller.

3. The stencil printer according to claim 1, wherein the at least one rotating roller comprises said press roller and a pair of resist rollers.

4. The stencil printer according to claim 3, wherein the pair of resist rollers are rotated not only at a time of conveying a printed sheet.

5. The stencil printer according to claim 3, wherein the pair of resist rollers are rotated at a time of making a master by a master making mechanism.

* * * * *